US008983362B2

(12) United States Patent
Nakamura

(10) Patent No.: US 8,983,362 B2
(45) Date of Patent: Mar. 17, 2015

(54) SHEET BINDING APPARATUS USING CONCAVE-CONVEX MEMBERS AND IMAGE FORMING APPARATUS HAVING SAME

(75) Inventor: Fumihiko Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 983 days.

(21) Appl. No.: 12/697,498

(22) Filed: Feb. 1, 2010

(65) Prior Publication Data

US 2010/0202814 A1 Aug. 12, 2010

(30) Foreign Application Priority Data

Feb. 12, 2009 (JP) ..... 2009-029690
Jan. 21, 2010 (JP) ..... 2010-010690

(51) Int. Cl.
*B65H 37/04* (2006.01)
*G03G 15/00* (2006.01)

(52) U.S. Cl.
CPC .. *G03G 15/6544* (2013.01); *G03G 2215/00848* (2013.01); *B65H 37/04* (2013.01); *B65H 2801/27* (2013.01); *B65H 2301/43828* (2013.01); *B65H 2403/512* (2013.01)
USPC ..... 399/408; 270/58.08

(58) Field of Classification Search
CPC ..... B41F 19/02; B41F 19/08; B42B 5/00; B42B 5/02; B31F 5/00; B31F 2201/0789; B31F 5/02; B42F 1/00; B42F 1/12; B42F 1/006
USPC ..... 399/408, 407, 409, 410; 270/58.08, 270/58.09, 58.11, 58.07; 493/451, 456; 101/31.1; 412/6, 7, 33
See application file for complete search history.

(56) References Cited

U.S. PATENT DOCUMENTS 3,797,821 A * 3/1974 Crenshaw, Jr. ..... 493/456
3,946,663 A * 3/1976 Engeriser ..... 101/3.1
4,534,089 A * 8/1985 Swan ..... 24/559

(Continued)

FOREIGN PATENT DOCUMENTS

EP 879658 A1 11/1998
JP 07-165365 A 6/1995
JP 09-104183 A 4/1997

(Continued)

*Primary Examiner* — Matthew G Marini
*Assistant Examiner* — Justin Olamit
(74) *Attorney, Agent, or Firm* — Fitzpatrick, Cella, Harper & Scinto

(57) ABSTRACT

A sheet binding apparatus which forms concavity and the convexity on a sheet bundle including a plurality of sheets in a thickness direction so as to bind the sheet bundle, the sheet binding apparatus includes: a pair of concave-convex members, each of which has concave-convex portion in the thickness direction of the sheet bundle and which forms the concavity and the convexity on the sheet bundle in the thickness direction while niping the sheet bundle therebetween; wherein in the pair of concave-convex members, one of the concave-convex members has a greater difference in height of the concave-convex portion than that of the other concave-convex member which engages with the above-described concave-convex member.

11 Claims, 6 Drawing Sheets

(56) References Cited

U.S. PATENT DOCUMENTS

| | | | | |
|---|---|---|---|---|
| 4,820,255 | A * | 4/1989 | Nanami | 493/451 |
| 5,774,232 | A * | 6/1998 | Tabata et al. | 358/448 |
| 6,059,281 | A | 5/2000 | Nakamura et al. | |
| 6,115,905 | A | 9/2000 | Ueta | |
| 6,152,442 | A | 11/2000 | Nishinohara et al. | |
| 6,392,763 | B1 | 5/2002 | Nishinohara et al. | |
| 6,754,937 | B1 * | 6/2004 | Martin | 24/351 |
| 7,376,382 | B2 * | 5/2008 | Shibata | 399/401 |

FOREIGN PATENT DOCUMENTS

| | | | |
|---|---|---|---|
| JP | 09-141351 | A | 6/1997 |
| JP | 2004-155537 | | 6/2004 |
| JP | 2004155537 | A * | 6/2004 |
| WO | 97/18911 | A1 | 5/1997 |
| WO | 2009/110298 | A | 9/2009 |

* cited by examiner

SHEET BINDING APPARATUS USING CONCAVE-CONVEX MEMBERS AND IMAGE FORMING APPARATUS HAVING SAME

BACKGROUND OF THE INVENTION

1. Field of the Invention

The present invention relates to a sheet binding apparatus for binding a sheet bundle including a plurality of sheets and an image forming apparatus provided with the sheet binding apparatus.

2. Description of the Related Art

There has been widely used a stapling unit for binding a sheet bundle including a plurality of sheets by using a stapling member such as a metallic staple as a sheet binding apparatus for binding together sheets having images formed thereon by an image forming apparatus such as a copying machine or a printer.

However, in the case where each of the sheets in the stapled sheet bundle is used as a original to be read in a copying operation, the staple in the sheet bundle need to be removed. Otherwise, also in the case where the stapled sheet bundle is recycled, the staple in the sheet bundle need to be removed to be recycled separately from the sheet from the viewpoint of environmental issues. In either case, cumbersome work is needed. In addition, the staple is wasted after the use, thereby inducing a profligate use of resources.

In view of the above, there has been proposed an apparatus provided with a sheet binding portion having concave portions and convex portions, which forms concavity and convexity on a part of a sheet bundle conveyed to a stapling position, as a sheet binding apparatus in which cumbersome work in reusing sheets as originals or recycling the sheets is alleviated and the profligate use of resources is reduced without using any staple.

However, in a sheet binding apparatus disclosed in Japanese Patent Application Laid-open No. 2004-155537, concave portions and convex portions which constitute a sheet binding portion are formed into engageable sizes (i.e., into the same shape). Therefore, the concave portions and convex portions are brought into contact with each other in substantially the entire area via a sheet bundle when the concavity and the convex portion are formed on the sheet bundle. As a consequence, as the thickness of the sheet bundle becomes greater, a contact resistance becomes larger at the time of the formation of the concavity and the convex portion on the sheet bundle, thereby requiring a greater pressing force.

The number or arrangement of concavity and convex portion to be formed on the sheet bundle is changed in the sheet binding apparatus disclosed in Japanese Patent Application Laid-open No. 2004-155537 in order to perform a binding operation according to the thickness of the sheet bundle. However, in order to change the number or arrangement of concavity and convexity to be formed on the sheet bundle, it is necessary to replaceably provide a plurality of sheet binding portions in which numbers or arrangements of concavity and the convexity are different or provide a moving mechanism for moving the relative position between the sheet binding portion and the sheet bundle. In other words, a problem of a complicated configuration arises.

In view of the above, an object of the present invention is to provide a sheet binding apparatus capable of forming concavity and the convexity on a sheet bundle by a predetermined pressing force with a simple configuration irrespective of the thickness of the sheet bundle.

SUMMARY OF THE INVENTION

The present invention provides a sheet binding apparatus which forms concavity and convexity on a sheet bundle including a plurality of sheets in a thickness direction so as to bind the sheet bundle, the sheet binding apparatus including: a pair of concave-convex members, each of which has a concave-convex portion in the thickness direction of the sheet bundle and which forms the concavity and the convexity on the sheet bundle in the thickness direction while nipping the sheet bundle therebetween; wherein in the pair of concave-convex members, one of the concave-convex members has a greater difference in height of the concave-convex portion than that of the other concave-convex member.

According to the present invention, the pair of concave-convex members can be brought into contact with each other in a reduced area via the sheet bundle when the pair of concave-convex members forms the concavity and the convexity on the sheet bundle. Thus, even if the thickness of the sheet bundle is increased, the concavity and the convexity can be formed on the sheet bundle with a simple configuration by a small pressing force.

Further features of the present invention will become apparent from the following description of exemplary embodiments with reference to the attached drawings.

DESCRIPTION OF THE EMBODIMENTS

A detailed description will be illustratively given below of an embodiment according to the present invention with reference to the attached drawings. Incidentally, the dimensions, materials, and shapes of constituent parts, their relative arrangement, and the like described in the following embodiment should be appropriately varied according to the configuration of an apparatus, to which the present invention is applied, or various conditions. As a consequence, the present invention should not be limited to them, unless specifically stated.

Here, the embodiment will be described by way of an image forming apparatus provided with a sheet binding apparatus. Descriptions will be first given below of the image forming apparatus provided with the sheet binding apparatus, and subsequently, of the sheet binding apparatus.

Figure 6:
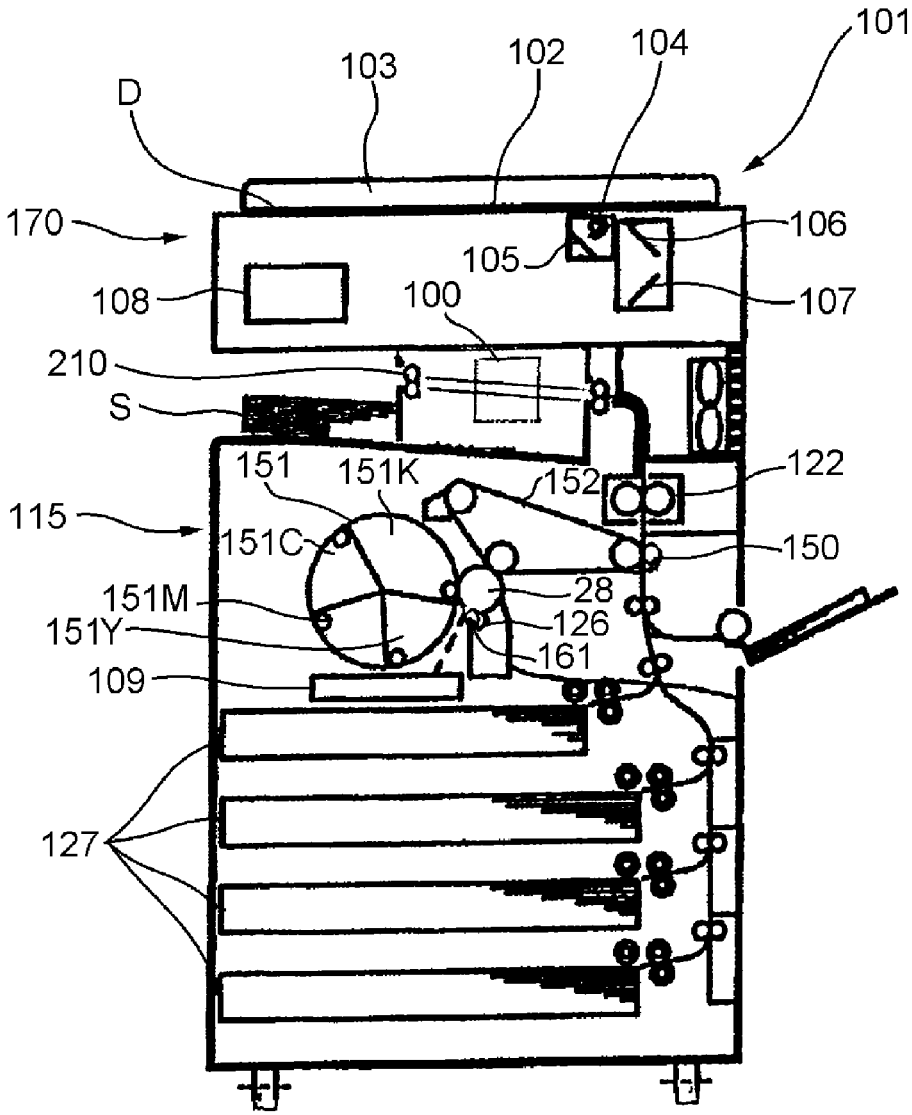
FIG. 6 is a cross-sectional view schematically illustrating an image forming apparatus.

First referring to FIG. 6, a description will be given below of the image forming apparatus provided with the sheet binding apparatus. FIG. 6 is a cross-sectional view schematically illustrating the image forming apparatus.

As illustrated in FIG. 6, an image forming apparatus 101 includes an image reading portion 170 and an image forming portion 115. At the upper section of the image reading portion 170 is provided an original base plate 102 which is securely disposed and formed of a transparent glass plate. An original D is placed at a predetermined position of the original base plate 102 with an image facing downward, to be then securely pressed against an original press-fitting plate 103. Under the original base plate 102, there is provided an optical system including a lamp 104 for illuminating the original D and reflection mirrors 105, 106, and 107 for guiding a light image of the illuminated original D to an image processing unit 108. The lamp 104 and the reflection mirrors 105, 106, and 107 are moved at a predetermined speed, thereby scanning the original D.

The image forming portion 115 includes a photosensitive drum 28, a primary charging roller 161, a rotary developing unit 151, an intermediate transfer belt 152, a transfer roller 150, a cleaner 126, and the like. In the photosensitive drum 28, the light image is irradiated with a laser beam from a laser unit 109 based on image data. Thereafter, an electrostatic latent image is formed on the photosensitive drum 28. The primary charging roller 161 is adapted to uniformly charge the surface of the photosensitive drum 28 before the irradiation of the laser beam. The rotary developing unit 151 allows toners of magenta (M), cyan (C), yellow (Y), and black (K) colors to adhere to the electrostatic latent image formed on the photosensitive drum 28, thereby forming a toner image. The toner image developed on the photosensitive drum 28 is transferred onto the intermediate transfer belt 152. The toner image transferred onto the intermediate transfer belt 152 is transferred onto a sheet S by the transfer roller 150. The cleaner 126 removes the toner remaining on the photosensitive drum 28 after the toner image is transferred.

Here, a description will be given of the rotary developing unit 151. The rotary developing unit 151 uses a rotational development system, is provided with a developing device 151K, a developing device 151Y, a developing device 151M, and a developing device 151C, and is rotatable by a motor (not illustrated). When a monochromatic toner image is formed on the photosensitive drum 28, the developing device 151K is rotationally moved to a development position in the proximity with the photosensitive drum 28, followed by development. Similarly, when a full-color toner image is formed, the rotary developing unit 151 is rotated, and then, each of the developing devices is moved to the development position, so that development is performed in the order of the colors.

The toner image developed on the photosensitive drum 28 by the rotary developing unit 151 is transferred onto the intermediate transfer belt 152. The toner image on the intermediate transfer belt 152 is transferred onto the sheet S by the transfer roller 150. The sheet S is supplied from any of sheet cassettes 127.

A fixing portion 122 is disposed downstream of the image forming portion 115, to fix the toner image formed on the transported sheet S as a permanent image. The sheet S having the toner image fixed thereto in the fixing portion 122 is selectively subjected to binding by a sheet binding apparatus 100, described later. Hence, the sheet or a sheet bundle is discharged to a discharging portion 125 disposed outside of the apparatus via a pair of discharge rollers 210.

Figure 1:
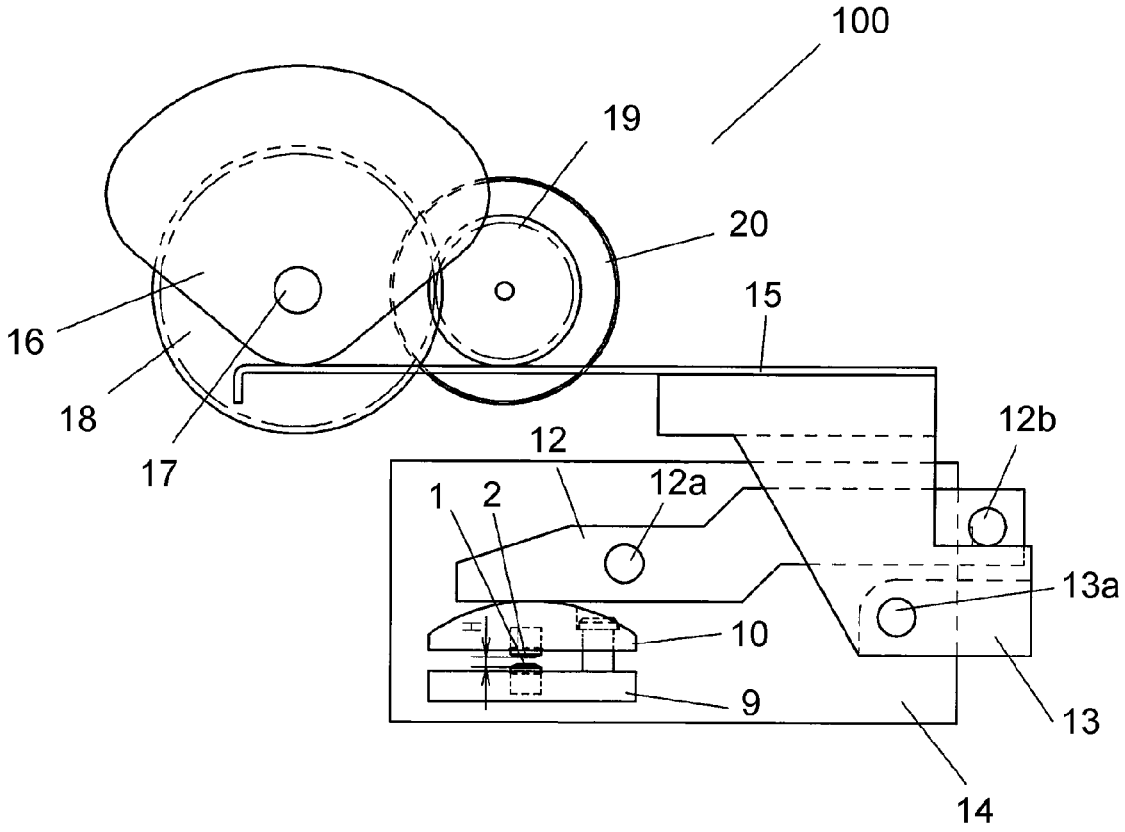
FIG. 1 is a cross-sectional view schematically illustrating a sheet binding apparatus.
Figure 2A:
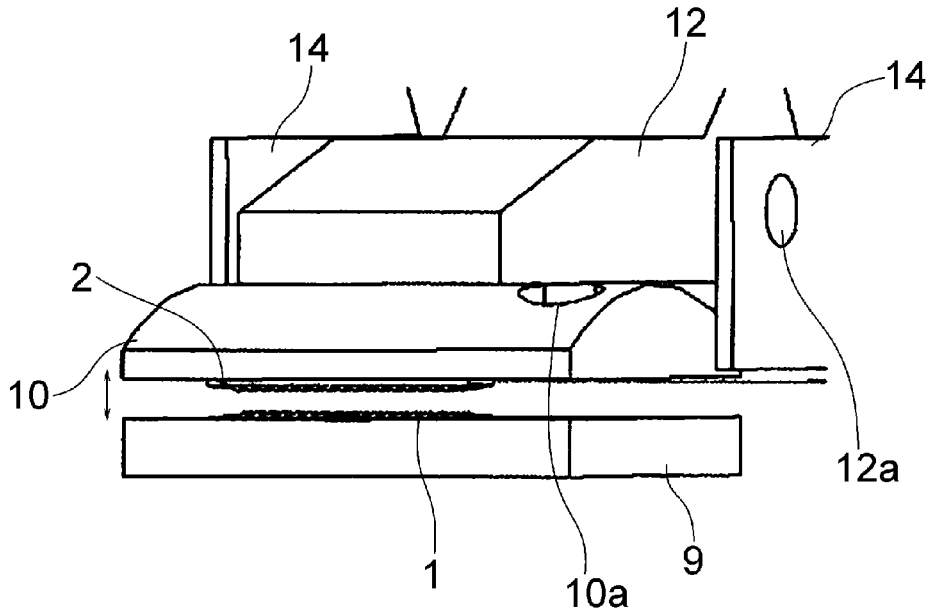
FIG. 2A is a perspective view illustrating, in enlargement, the surroundings of a supporting portion of a concave-convex member in the sheet binding apparatus.
Figure 2B:
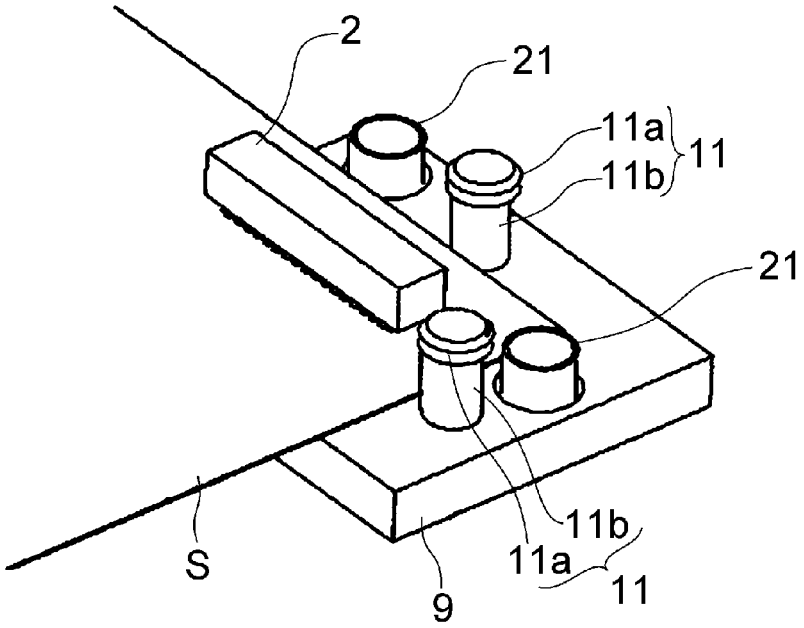
FIG. 2B is a top perspective view illustrating the sheet binding apparatus in which an upper support is removed.
Figure 3:
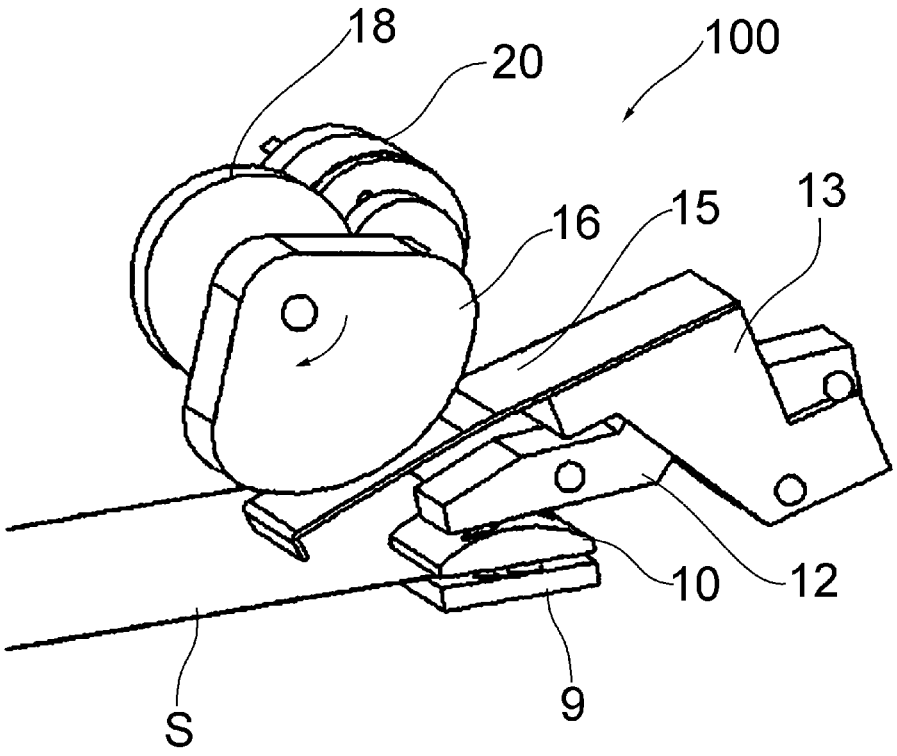
FIG. 3 is a perspective view illustrating the sheet binding apparatus in a binding state.

Subsequently, a sheet binding apparatus will be described with reference to FIGS. 1 to 6. First of all, a description will be given of the schematic configuration of the sheet binding apparatus by way of FIGS. 1 to 3. FIG. 1 is a cross-sectional view schematically illustrating the sheet binding apparatus; FIG. 2A is a perspective view illustrating, in enlargement, the surroundings of a supporting portion of a concave-convex member in the sheet binding apparatus; FIG. 2B is a top perspective view illustrating the sheet binding apparatus in which an upper support is removed; and FIG. 3 is a perspective view illustrating the sheet binding apparatus in a binding state.

As illustrated in FIG. 1, the sheet binding apparatus 100 is adapted to bind a bundle of a plurality of sheets without using a binding member such as a staple. The sheet binding apparatus 100 is provided with a pair of concave-convex members 1 and 2 for binding a sheet bundle. The pair of concave-convex members 1 and 2 is disposed movably in the direction of the thickness of the sheet bundle, for forming concavity and the convexity in the direction of the thickness of the sheet bundle while nipping the sheet bundle therebetween, so as to bind the sheet bundle together in contact.

A concave-convex member disposed on a lower side (hereinafter referred to as a lower concave-convex member) 1 is supported by a support on the lower side (hereinafter referred to as a lower support) 9 via a screw or the like. In the same manner, a concave-convex member disposed on an upper side (hereinafter referred to as an upper concave-convex member) 2 is supported by a support on the upper side (hereinafter referred to as an upper support) 10 via a screw or the like. Each of the concave-convex members 1 and 2 has concave-convex shape including a series of concave portions and convex portions in the same arrangement pitch. Here, the arrangement pitch signifies a pitch between adjacent convex portions 2*a* (or convex portions 1*a*) or a pitch between adjacent concave portions 2*b* (or concave portions 1*b*) (see FIG. 4).

As illustrated in FIG. 2B, the lower support 9 for supporting the lower concave-convex member 1 includes two guide pins 11 for positioning, in abutment, corners of the sheet bundle nipped between the concave-convex members 1 and 2. In the meantime, as illustrated in FIG. 2A, the upper support 10 for supporting the upper concave-convex member 2 includes guide holes 10*a* for guiding the guide pins 11 in the lower support 9 in movable engagement. As illustrated in FIG. 2B, the guide pin 11 includes a guide portion 11*b* for movably guiding the upper support 10 in the direction of the thickness of the sheet bundle and a stopper portion 11*a* for preventing the upper support 10 from dropping from the guide pin 11. The upper support 10 is upward urged by compression springs 21 disposed in the lower support 9. The top dead center of the upper support 10 upward urged is determined at a position where the upper support 10 abuts against the stopper portion 11*a* of the guide pin 11 having a diameter greater than that of the guide hole 10*a*. In contrast, the bottom dead center of the upper support 10 is determined at a position where the upper and lower concave-convex members 1 and 2 abut against each other.

As illustrated in FIG. 1, the concave-convex members 1 and 2 serve as a fixed concave-convex member which is fixed at a predetermined position and a moving concave-convex member which is movable in the direction of the thickness of the sheet bundle with respect to the fixed concave-convex member, respectively. Here, the lower support 9 is secured to a frame 14 in the lower concave-convex member 1 out of the pair of concave-convex members 1 and 2, and therefore, it serves as the fixed concave-convex member which is fixed at the predetermined position. In contrast, the upper support 10 can be moved in the direction of the thickness of the sheet bundle along the guide pins 11 in the upper concave-convex member 2, and therefore, it serves as the moving concave-convex member which is movable in the direction of the thickness of the sheet bundle with respect to the lower concave-convex member 1. A binding unit is composed of the concave-convex members 1 and 2, the lower support 9, the upper support 10 and the frame 14. One end of a moving arm 12 turnably supported on an axis 12*a* with respect to the frame 14 abuts against the upper surface of the upper support 10 for supporting the upper concave-convex member 2. The moving arm 12 is a moving portion for moving the upper support 10 from a retraction position, at which the concave-convex members 1 and 2 are separated at a greatest interval H by the effects of the compression springs 21 and the guide pins 11, to a binding position, at which the concave-convex members 1 and 2 engage with each other, along the guide pins 11. Here, the binding position is referred to as a first position at which the pair of concave-convex members 1 and 2 nips to bind the sheet bundle: in contrast, the retraction position is referred to as a second position at which the upper concave-convex member 2 retracts from the first position with respect to the lower concave-convex member 1 in the direction of the thickness of the sheet bundle.

As described above, the upper support 10 and the moving arm 12 normally stay in a state in which the pair of concave-convex members 1 and 2 is separated at the greatest interval H by the effects of the compression springs 21 and the guide pins 11. A pressurizing pin 12*b* for pressurizing a connection arm 13 turnably supported on an axis 13*a* with respect to the frame 14 is disposed at the other end of the moving arm 12. An arm plate 15 serving as an elastic member is secured to the upper portion of the connection arm 13. A cam 16 abuts against an upper surface of a free end of the arm plate 15. The vertical position of the arm plate 15 depends upon the phase of the cam 16. Drive force is transmitted to the cam 16 by a drive source, that is, a cam driving motor 20 via a motor gear 19, a drive force transmitting gear 18, and a cam driving shaft 17, thereby turning the cam 16.

As a consequence, when the cam 16 is turned, the connection arm 13, to which the arm plate 15 is secured, and the moving arm 12 are turned accordingly, so that the upper support 10 having the upper concave-convex member 2 is moved in the direction of the thickness of the sheet bundle along the guide pins 11 with respect to the lower support 9 having the lower concave-convex member 1. Specifically, when the cam 16 is turned from the state illustrated in FIG. 1 to the state illustrated in FIG. 3, the moving arm 12 is turned against the resiliency of the compression springs 21, so that the upper support 10 is moved to the binding position at which the upper concave-convex member 2 and the lower concave-convex member 1 engage with each other. At this time, pressing force exerted between the concave-convex members 1 and 2 is constant (about 100 kg herein). When the cam 16 is further turned from the state illustrated in FIG. 3 to the state illustrated in FIG. 1, the upper support 10 having the upper concave-convex member 2 is moved to the retraction position at which it abuts against the stopper portions 11*a* of the guide pins 11 by the resiliency of the compression springs 21. In this manner, one rotational drive of the cam 16 permits the pair of the concave-convex members 1 and 2 to perform binding work.

Figure 4A:
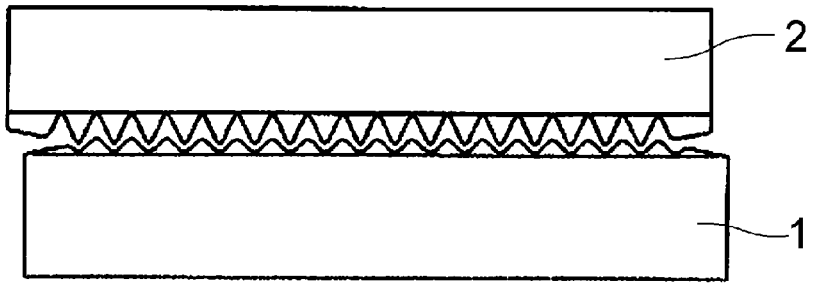
FIG. 4A is a cross-sectional view illustrating, in enlargement, upper and lower concave-convex members.
Figure 4B:
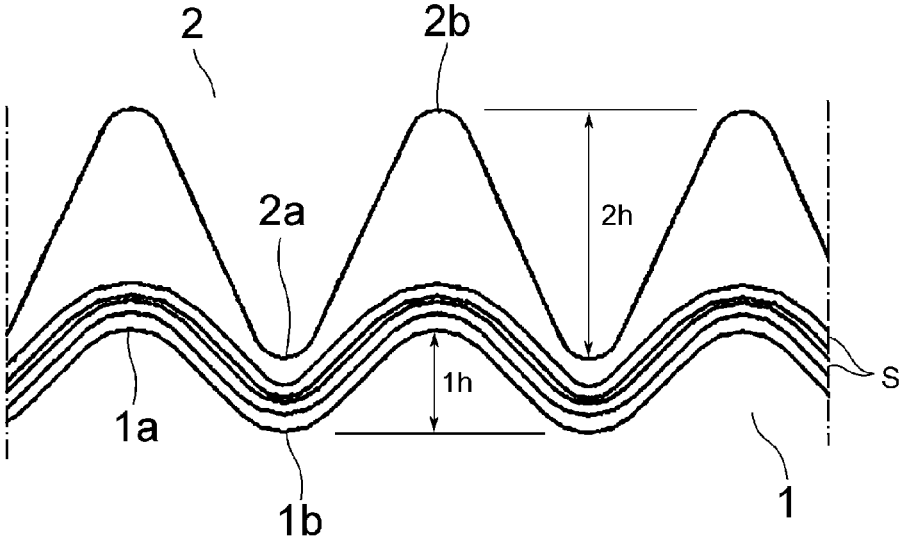
FIG. 4B is a cross-sectional view illustrating, in partly enlargement, a sheet bundle and the upper and lower concave-convex members in the binding process state.
Figure 4C:
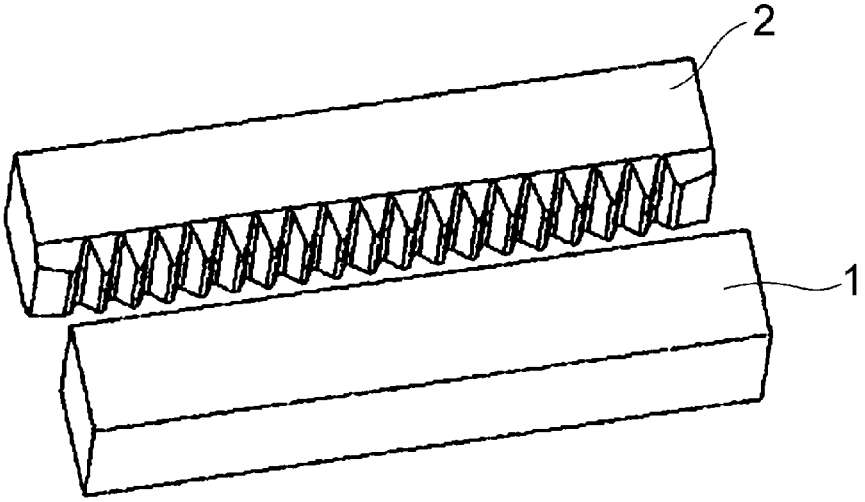
FIG. 4C is a perspective view illustrating, in enlargement, the upper and lower concave-convex members.

Next, a description will be given of the relationship between the pair of the concave-convex members with reference to FIGS. 4A to 4C. FIG. 4A is a cross-sectional view illustrating, in enlargement, the upper and lower concave-convex members 1 and 2; FIG. 4B is a cross-sectional view illustrating, in partly enlargement, the sheet bundle S and the upper and lower concave-convex members 1 and 2 in the binding state; and FIG. 4C is a perspective view illustrating, in enlargement, the upper and lower concave-convex members 1 and 2.

As illustrated in FIG. 4B, the upper concave-convex member 2 has concave-convex shape including the convex portions 2*a* and the concave portions 2*b* in continuation. In the same manner, the lower concave-convex member 1 has concave-convex shape including the convex portions 1*a* and the concave portions 1*b* in continuation. Assuming that 2*h* represents a difference in height between the convex portion 2*a* and the concave portion 2*b* in the upper concave-convex member 2 whereas 1*h* represents a difference in height between the convex portion 1*a* and the concave portion 1*b* in the lower concave-convex member 1, the relationship of $2h>1h$ is established. That is to say, the height 2*h* of the convex portion 2*a* of the concave-convex member 2 is greater than the height 1*h* of the concave portion 1*b* of the concave-convex member 1, which is engageable with the convex portion 2*a*, in the pair of concave-convex members 1 and 2. In this way, when the pair of concave-convex members 1 and 2 forms concavity and convexity on the sheet bundle S, a contact area therebetween via the sheet bundle S can be reduced. Moreover, the inclined angle of a surface connected between the concavity and the convexity of the upper concave-convex member 2 serving as the moving concave-convex member becomes acuter since its arrangement pitch is equal to that of the lower concave-convex member 1 serving as the fixed concave-convex member whereas its difference in height of the concavity and the convexity is greater than that of the lower concave-convex member 1, thus reducing resistance occurring when the sheet bundle is pressed. As a consequence, even if the thickness of the sheet bundle is slightly increased, the concavity and the convexity can be certainly formed. Additionally, a surface connected between the concavity and the convexity of the lower concave-convex member 1 having a moderate inclined angle supports the sheet bundle, thereby preventing any breakage of the sheet when the concavity and the convexity are formed.

Figure 5A:
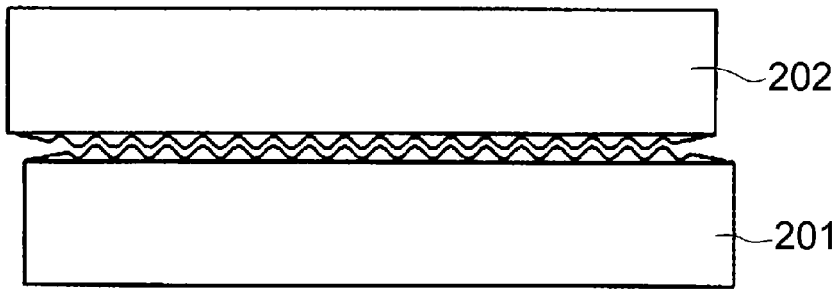
FIG. 5A is a cross-sectional view illustrating, in enlargement, upper and lower concave-convex members in a comparative example.

Here, a concave-convex member will be described in a comparative example by way of FIGS. 5A and 5B. Concave-convex members 201 and 202 illustrated in FIGS. 5A and 5B have the same tooth height. FIG. 5A is a cross-sectional view illustrating, in enlargement, the upper and lower concave-convex members 201 and 202; and FIG. 5B is a cross-sectional view illustrating, in partly enlargement, a sheet bundle S and the upper and lower concave-convex members 201 and 202 in a binding state.

Figure 5B:
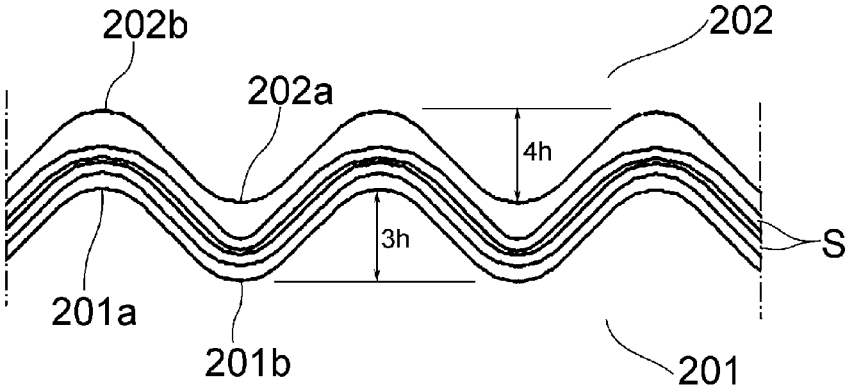
FIG. 5B is a cross-sectional view illustrating, in partly enlargement, a sheet bundle and the upper and lower concave-convex members in the binding process state in the comparative example.

As illustrated in FIG. 5B, the upper concave-convex member 202 has concave-convex shape including convex portions 202*a* and concave portions 202*b* in continuation. In the same manner, the lower concave-convex member 201 has concave-convex shape including convex portions 201*a* and concave portions 201*b* in continuation. In the pair of concave-convex members 201 and 202, a height 4*h* of the convex portion 202*a* in the concave-convex member 202 is equal to a height 3*h* of the concave portion 201*b* in the concave-convex member 201, which is engageable with the convex portion 202*a* ($4h=3h$).

Consequently, in the upper and lower concave-convex members 201 and 202 illustrated in FIG. 5B, when concavity and the convexity are formed on the sheet bundle S, the counterpart concave-convex portion is pressed in contact in the entire area via the sheet bundle S. Therefore, a contact resistance is greater in the upper and lower concave-convex members 201 and 202 illustrated in FIG. 5B than that in the case illustrated in FIG. 4B, and therefore, pressing force in forming the concavity and the convexity on the sheet bundle is dispersed, thereby requiring a greater pressing force. Incidentally, pressing force obtained in an experiment with the configuration in the comparative example illustrated in FIG. 5B by using a sheet bundle under a predetermined condition (the number of sheets and its thickness) was about 300 kg.

In contrast, in the upper and lower concave-convex members 1 and 2 illustrated in FIG. 4B, the convex portion 2*a* of the upper concave-convex member 2 and the concave portion 1*b* of the lower concave-convex member 1 nip the sheet bundle S, and the concave portion 2*b* of the upper concave-convex member 2 and the convex portion 1*a* of the lower concave-convex member 1 do not nip the sheet bundle S. Thus only the vicinity of the tip of the convex portion 2*a* of the upper concave-convex member 2 abuts against the sheet bundle S whereas the vicinity of the concave portion 2*b* in continuation with the convex portion 2*a* is not brought into contact with the sheet bundle S, and therefore, a contact resistance can be reduced in comparison with the configuration illustrated in FIG. 5B. As a consequence, the pressing force cannot be dispersed but can be locally exerted, so that the concavity and the convexity can be certainly formed. Incidentally, pressing force obtained in an experiment with the configuration in the present embodiment illustrated in FIG. 4B by using a sheet bundle under the same condition (the number of sheets and its thickness) was about 100 kg.

With the configuration in the present embodiment, the concavity and the convexity can be formed by a substantially predetermined pressing force (about 100 kg) up to a bundle of 10 sheets (a sheet being 64 g in grammage). An experiment of formation of concavity and the convexity on a bundle of 2 sheets resulted in a pressing force of about 100 kg which is equal to that in the case of the bundle of 10 sheets. In contrast, an experiment in the comparative example which has been described with reference to FIGS. 5A and 5B resulted in that a bundle of 2 sheets could be bound at a pressing force of about 100 kg in forming concavity and the convexity thereon. In the comparative example, a greater pressing force is needed as the sheet bundle becomes thicker. In contrast, the sheet bundle can be bound by a predetermined pressing force irrespective of the thickness of the sheet bundle in the present embodiment.

As described above, the contact area between the pair of concave-convex members via the sheet bundle can be reduced in forming the concavity and the convexity on the sheet bundle only by giving the difference in height between the counterpart concave-convex members. As a consequence, it is possible to reduce the contact resistance, so as to form the concavity and the convexity on the sheet bundle by the predetermined pressing force with the simple configuration irrespective of the thickness of the sheet bundle. In other words, even if the thickness of the sheet bundle is increased, the concavity and the convexity can be formed on the sheet bundle by a smaller pressing force with the simple configuration.

Although the configuration in which the concave-convex member is fixed to the support via the screw or the like has been described in the above-described embodiment, it is not limited to this. The concave-convex member may be integrated with the support.

Moreover, although the configuration in which the height of the convex portion of the upper concave-convex member is greater than that of the concave portion of the lower concave-convex member engaging with the upper concave-convex member has been described in the above-described embodiment, it is not limited to this. The same advantageous result can be produced even by replacing the upper and lower concave-convex members with each other.

Additionally, although the configuration in which the lower concave-convex member out of the pair of concave-convex members is fixed whereas the upper concave-convex member is movable has been described in the above-described embodiment, it is not limited to this. For example, the upper concave-convex member may be fixed whereas the lower concave-convex member may be movable. Otherwise, without taking the configuration in which one out of the pair of concave-convex members is fixed whereas the other is movable, both members may be movable. In such a case, the same advantageous result can be produced by providing the difference in height between the pair of concave-convex members.

In addition, although the configuration in which the movable concave-convex member can be moved between the binding position and the retraction position in such a manner as to achieve a reciprocating motion in the direction of the thickness of the sheet bundle has been described in the above-described embodiment, it is not limited to this. For example, the movable concave-convex member may be movably rotated between the binding position, that is, a concavity and the convexity formation position, and the retraction position, thus producing the same advantageous result.

Furthermore, although the configuration in which the sheet bundle positionally abuts against the guide pins 11, as illustrated in FIG. 2B, has been described in the above-described embodiment, it is not limited to this. For example, the position or angle of the upper and lower concave-convex members with respect to the sheet bundle S may be determined by using an automatic position changing portion for automatically changing a position or an angle or varying the shape of the support for supporting the concave-convex member.

Moreover, although the image forming apparatus has been exemplified by the copying machine in the above-described embodiment, it is not limited to this. For example, the image forming apparatus may be exemplified by an image forming apparatus such as a printer or a facsimile or another image forming apparatus such as a composite machine compositely having the functions of the printer and the facsimile. The same advantageous result can be produced by applying the present invention to a sheet binding apparatus for use in such an image forming apparatus.

Additionally, although the configuration in which the image forming apparatus integrally provided with the sheet binding apparatus has been described in the above-described embodiment, it is not limited to this. A sheet binding apparatus may be detachably attached to the image forming apparatus. The same advantageous result can be produced by applying the present invention to such a sheet binding apparatus. Furthermore, although the sheet binding apparatus, connected to the image forming apparatus online, has been described in the above-described embodiment, it is not limited to this. A sheet binding apparatus may be manually-operable. The same advantageous result can be produced by applying the present invention to such a sheet binding apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-029690, filed Feb. 12, 2009, and No. 2010-010690, filed Jan. 21, 2010, which are hereby incorporated by reference herein in their entirety.

What is claimed is:

1. A sheet binding apparatus which binds a plurality of sheets, comprising:

a binding unit which has a fixed concave-convex member which is fixed at a predetermined position and a movable concave-convex member disposed above the fixed concave-convex member, the movable concave-convex member movable with respect to the fixed concave-convex member; and a moving portion which moves the movable concave-convex member from a first position at which the movable concave-convex member is separated from the fixed concave-convex member to a second position at which the movable concave-convex member and the fixed concave-convex member nip the plurality of sheets for binding together the plurality of sheets, wherein the fixed concave-convex member has a plurality of convex portions projecting upward and a plurality of concave portions formed between the convex portions and the movable concave-convex member has a plurality of convex portions projecting downward and a plurality of concave portions formed between the convex portions, and an arrangement pitch of the convex portions and the concave portions of the fixed concave-convex member is equal to an arrangement pitch of the convex portions and the concave portions of the movable concave-convex member, and wherein an angle between a vertical plane and a planar surface between a concavity and convexity of the movable concave-convex member is different from an angle between a vertical plane and a planar surface between a concavity and convexity of the fixed concave-convex member, and a height of the convex portion projecting downward of the movable concave-convex member is different from a height of the convex portion projecting upward of the fixed concave-convex member.

2. The sheet binding apparatus according to claim 1, wherein the moving portion moves all of the convex portions and concave portions of the movable concave-convex member at once to a position where the plurality of the sheets is bound.

3. The sheet binding apparatus according to claim 1, wherein an angle between a vertical plane and a planar surface between the concavity and convexity of the movable concave-convex member is smaller than an angle between a vertical plane and a planar surface between the concavity and convexity of the fixed concave-convex member, and a height of the convex portion projecting downward of the movable concave-convex member is larger than a height of the convex portion projecting upward of the fixed concave-convex member.

4. The sheet binding apparatus according to claim 1, wherein in a range where the movable concave-convex member and the fixed concave-convex member nips the plurality of sheets, the plurality of convex portions of the fixed concave-convex member have a same shape and the plurality of concave portions of the fixed concave-convex member have a same shape, as well as the plurality of convex portions of the movable concave-convex member have a same shape and the plurality of concave portions of the movable concave-convex member have a same shape.

5. The sheet binding apparatus according to claim 1, wherein the moving portion includes a motor configured to generate a driving power and a cam configured to move the movable concave-convex member by being rotated by the motor.

6. An image forming system comprising:

an image forming portion which forms an image on a sheet; and a sheet binding apparatus which binds a sheet bundle including a plurality of image formed sheets, the sheet binding apparatus including:

a binding unit which has a fixed concave-convex member which is fixed at a predetermined position and a movable concave-convex member disposed above the fixed concave-convex member, the movable concave-convex member movable with respect to the fixed concave-convex member, a moving portion which moves the movable concave-convex member from a first position at which the movable concave-convex member is separated from the fixed concave-convex member to a second position at which the movable concave-convex member and the fixed concave-convex member nip the plurality of sheets for binding together the plurality of sheets, wherein the fixed concave-convex member has a plurality of convex portions projecting upward and a plurality of concave portions formed between the convex portions and the movable concave-convex member has a plurality of convex portions projecting downward and a plurality of concave portions formed between the convex portions, and an arrangement pitch of the convex portions and the concave portions of the fixed concave-convex member is equal to an arrangement pitch of the convex portions and the concave portions of the movable concave-convex member, and wherein an angle between a vertical plane and a planar surface between a concavity and convexity of the movable concave-convex member is different from an angle between a vertical plane and a planar surface between a concavity and convexity of the fixed concave-convex member, and a height of the convex portion projecting downward of the movable concave-convex member is different from a height of the convex portion projecting upward of the fixed concave-convex member.

7. The image forming system according to claim 6, wherein the moving portion moves all of the convex portions and concave portions of the movable concave-convex member at once to a position where the plurality of the sheets is bound.

8. The image forming system according to claim 6, wherein the fixed concave-convex member and the movable concave-convex member are mountain-shaped teeth.

9. The image forming apparatus according to claim 6, wherein an angle between a vertical plane and a planar surface between the concavity and convexity of the movable concave-convex member is smaller than an angle between a vertical plane and a planar surface between the concavity and convexity of the fixed concave-convex member, and a height of the convex portion projecting downward of the movable concave-convex member is larger than a height of the convex portion projecting upward of the fixed concave-convex member.

10. The image forming apparatus according to claim 6, wherein in a range where the movable concave-convex member and the fixed concave-convex member nips the plurality of sheets, the plurality of convex portions of the fixed concave-convex member have a same shape and the plurality of concave portions of the fixed concave-convex member have a same shape, as well as the plurality of convex portions of the movable concave-convex member have a same shape and the plurality of concave portions of the movable concave-convex member have a same shape.

11. The image forming apparatus according to claim 6, wherein the moving portion includes a motor configured to generate a driving power and a cam configured to move the movable concave-convex member by being rotated by the motor.

* * * * *